US006296197B1

(12) United States Patent
Boecking

(10) Patent No.: US 6,296,197 B1
(45) Date of Patent: Oct. 2, 2001

(54) INJECTION VALVE FOR A FUEL SYSTEM OF A VEHICLE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/308,715

(22) PCT Filed: Apr. 7, 1998

(86) PCT No.: PCT/DE98/00971

§ 371 Date: Jun. 30, 1999

§ 102(e) Date: Jun. 30, 1999

(87) PCT Pub. No.: WO99/15779

PCT Pub. Date: Apr. 1, 1999

(30) Foreign Application Priority Data

Sep. 23, 1997 (DE) ..... 197 41 850

(51) Int. Cl.[7] ..... F02M 47/02

(52) U.S. Cl. ..... 239/88; 239/96; 239/533.2; 239/533.8; 239/102.1; 123/496; 123/504

(58) Field of Search ..... 239/88, 89, 92, 239/96, 102.1, 102.2, 533.2, 533.8, 585.1, 585.5; 123/447, 496, 498, 504

(56) References Cited

U.S. PATENT DOCUMENTS 4,403,740 * 9/1983 Eblen et al. ..... 239/533.2
4,669,668 * 6/1987 Ogawa ..... 239/533.8 X
4,684,067 * 8/1987 Cotter et al. ..... 239/533.8 X
5,694,903 * 12/1997 Ganser ..... 239/96 X

* cited by examiner

*Primary Examiner*—Steven J. Ganey
(74) *Attorney, Agent, or Firm*—Ronald E. Greigg; Edwin E. Greigg

(57) ABSTRACT

An injection valve for a fuel injection system, for multistage control of the effective cross section of an injection opening. A spring/stop system with a first compression spring for a control valve for a control chamber, whose pressure determined the position of the valve shaft of an injection valve member. When a valve opens, the spring/stop system allows its valve tappet a first axial stroke, which is limited by a primary stop on an axially movable adapter. The axial mobility of the adapter allows the valve tappet, counter to the compressive force of a first compression spring, an additional, second axial stroke, which is limited by an end stop structurally connected to the housing. The valve tappet is urged in the closing direction of the control valve by a second compression spring braced against the housing of the injection valve, and in the closed state of the control valve the spring force of the second compression spring is less than that of the first compression spring. Applicable to a control valve of a common rail injector.

3 Claims, 2 Drawing Sheets

INJECTION VALVE FOR A FUEL SYSTEM OF A VEHICLE

PRIOR ART

The invention is based an injection valve for a fuel system of a vehicle.

One such injection valve is known from U.S. Pat. No. 5,458,293. In terms of its construction, such an injection valve can be composed of multiple function groups. A first function group includes a metering valve for the fuel, with injection openings and a valve shaft. A second function group includes an actuator as its drive mechanism. A third function group can be disposed between these first two function groups; it serves the purpose of servo assistance and can also be called a travel booster. This function group has a control chamber, which communicates hydraulically with a high-pressure reservoir via a primary throttle (inlet throttle) and can be relieved via a secondary throttle (outlet throttle) and a relief valve.

Finally, between this third function group and the actuator, a fourth function group can also be connected, assuring a hydraulic step-up of the travel distance. One example of an injection valve with all four function groups is given in German Patent DE 19 19 192 C1. This patent also addresses the object, in terms of what is known as preinjection, of making the smallest possible replicable preinjection quantities possible. U.S. Pat. No. 5,458,293, conversely, addresses not preinjection but rather the furnishing of a graduated course of the injection quantity by means of different opening stroke lengths of the closing member of an injection valve, at various supply pressures or injection pressures.

The present invention—unlike U.S. Pat. No. 5,458,293—has to do with the function group that has a control valve for servo assistance, and the object of the invention is to improve the suitability of an injection valve for the preinjection and the main injection.

ADVANTAGES OF THE INVENTION

The subject of the invention, has the following advantage:

In the preinjection, short switching times at the control valve can be attained, and the flow quantity through the control valve is limited. The invention makes it possible to construct an injection valve that is controlled by a piezoelectric actuator. Such an injection valve is suitable as a common rail injector, for example.

With the injection valve of the invention, two switching stages can be realized, with high stroke-length precision. The first axial stroke for the preinjection can be reduced sharply. This also reduces the switching time, while it becomes possible to attain a long stroke for the main injection.

Advantageous refinements are recited hereinafter, the characteristics of which can also be combined with one another, where appropriate.

In one variant, a compression spring is connected parallel to a helical spring during the traversal of another second axial stroke; in the variant, one compression spring and one helical spring are connected in series with one another. In both cases, a compact construction can be attained in that a piezoelectric actuator is used, and the two compression springs are disposed in the region between the piezoelectric actuator and the head of the control valve. If the adapter is guided on the valve tappet of the control valve, fluttering motions can be readily avoided.

BRIEF DESCRIPTION OF THE DRAWINGS

One exemplary embodiment of the invention is shown in the drawing and described in further detail in the ensuing description.

Substantially identical parts in the different figures are identified by the same reference numerals.

DESCRIPTION OF THE PREFERRED EXEMPLARY EMBODIMENT

Figure 1:
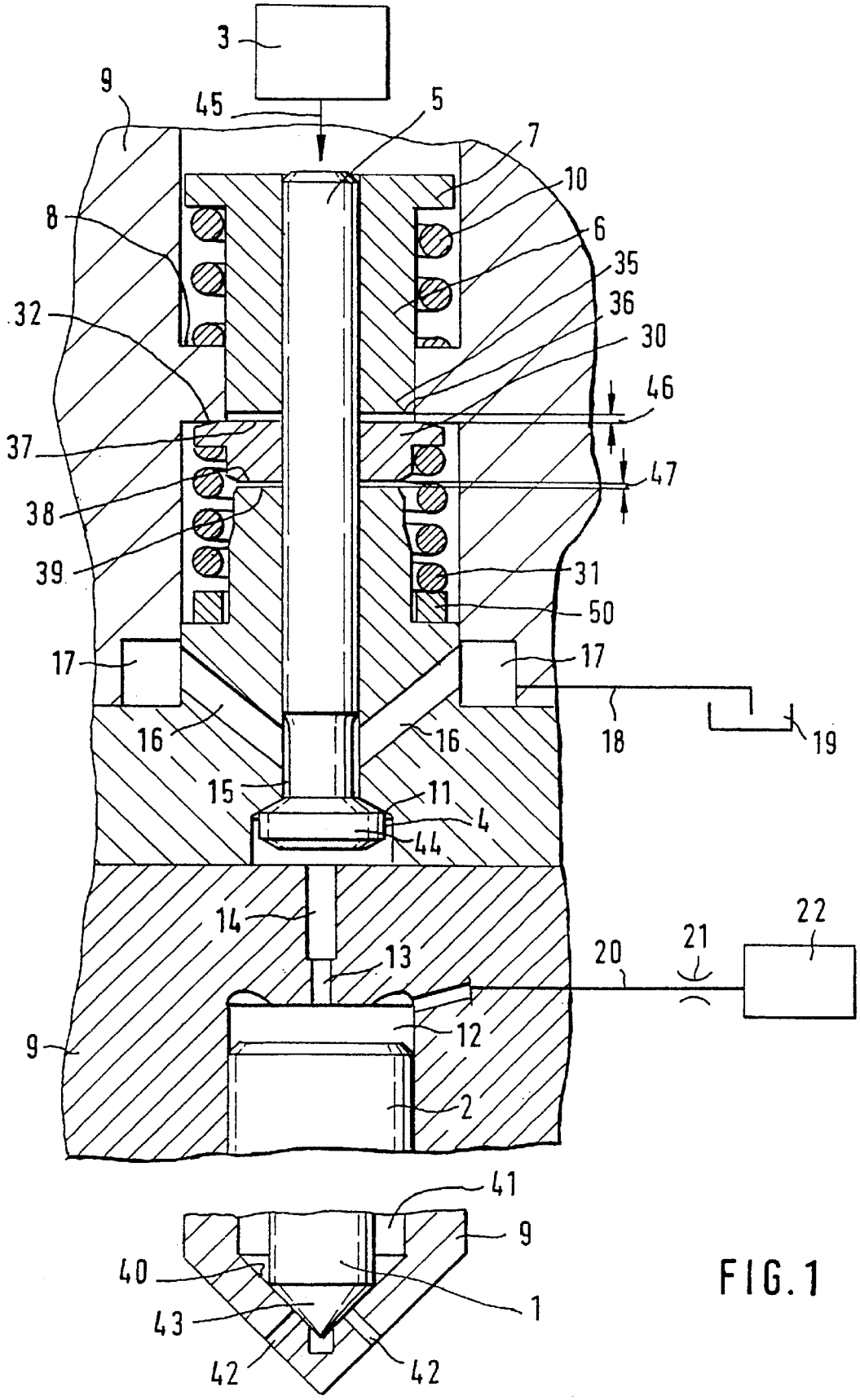
FIG. 1, in a fragmentary section, shows an enlarged detail of a preferred exemplary embodiment of an injection valve of the invention.

In the injection valve of FIG. 1, between an injection valve member 1 with a valve shaft 2 and a piezoelectric actuator 3, a function group is provided whose basic component is a control valve 4 with a valve tappet 5, upon which the piezoelectric actuator 3 acts. On its end toward the combustion chamber, the injection valve member 1 has a conical sealing face 43, which cooperates with a conical valve seat 40, from which injection bores 42 lead away to the combustion chamber of the associated internal combustion engine.

A ring 6, embodied on its top as a flange 7, is press-fitted onto the valve tappet 5. Fastened between this flange 7 and a shoulder 8 in the housing 9 of the injection valve is a first compression spring 10. The first compression spring urges the valve tappet 5 in the closing direction of the control valve 4, whose valve head 44, in the closed state of the control valve, rests on a valve seat 11.

The valve shaft 2, in a guide cylinder that guides the valve shaft, defines a control chamber 12, leading away from the control chamber is an injection bore 14 through which control valve 4 controls the relief of the control chamber. To control the relief rate while the control valve 4 is open, an outlet throttle 13 is also provided in the relief bore. On the other side of the valve head 44 of the control valve 4 is an annular chamber 15, from which bores 16 lead away to an outlet ring 17. This outlet ring communicates with a low-pressure fluid tank 19 via a schematically shown outlet line 18.

The control chamber 12, conversely, via an inlet 20 and an intervening inlet throttle 21, which has a smaller cross section than the outlet throttle 13, communicates with a high-pressure fuel reservoir 22, so that when the control valve 4 is closed, the high fuel pressure established in the high-pressure fuel reservoir, which presses the injection valve member 1 by its sealing face 43 onto the valve seat 40, so as to prevent an injection in this state. An adapter 30 is guided axially movably on the valve tappet 5; in the state of repose, shown, the adapter is pressed against a housing stop 32 by a second compression spring 31.

The lower end of the ring 6 is embodied as a driver 35 for the adapter 30 and has a driver stop 36. This stop is spaced apart from the top of the adapter 30 by a distance that acts as a primary stop 37 for defining a first axial stroke 46 for control chamber relief for the preinjection. The underside of the adapter 30 is designated as a secondary stop 38. This secondary stop 38, in the state of repose shown, is spaced apart by a distance equivalent to a second axial stroke 47 from an end stop 39 structurally connected to the housing.

Mode of Operation of the Preferred Exemplary Embodiment

For the preinjection and the main injection, the injection valve member 1 must be lifted more or less far from its valve seat 40, so that fuel, which is present upstream of the valve seat via an annular chamber 41 communicating with the high-pressure fuel reservoir 22, can flow out into the combustion chamber through the then-opened injection openings 42. To that end, the pressure in the control chamber 12 must be relieved. Before the injection valve member opens, and as long as the control valve 4 is closed, the pressure is equivalent to that of the high-pressure reservoir 22. By opening the control valve 4 in stages, the control chamber 12 is pressure-relieved in stages, because fluid can flow out of the control chamber 12 into the container 19, and the flow to replenish it is limited via the throttle 21. Thus for graduated opening of the injection valve member 1, the valve head 44 of the control valve 4 must be lifted in stages from its valve seat 11. To that end, the piezoelectric actuator 3 is provided, which acts on the valve tappet 5. Given suitable electrical control, the piezoelectric actuator 3 exerts a variably strong actuator force on the valve tappet 5. If the actuator force 45 is low, then initially the soft first compression spring 10 is compressed, until the driver stop 36 has overcome the first axial stroke 46 which opens the valve 4 and valve 1 for the preinjection and meets the primary stop 37 of the adapter 30. From then on, a greater actuator force 45 is necessary, because the second compression spring 31 requires more force for its compression. Once that force has been overcome, the valve tappet 5, which is solidly joined to the ring 6, can execute a second axial stroke 47, until the gap between the secondary stop 38 on the adapter 30 and the end stop 39 on the housing closes. Then the control valve 4, and thus the injection valve member 1 as well, are fully open for the main injection.

The following characteristics of the exemplary embodiment shown in FIG. 1 contribute to the above mode of operation:

The control valve 4 is prestressed in the closing direction by the prestressed first compression spring 10, which is fastened between the housing 9 and the flange 7 on the valve tappet 5. The driver 5, rigidly joined to the valve tappet 5, is spaced apart in the position of repose from the primary stop 37 of the spring-supported adapter 30 by a distance equivalent to the first axial stroke 46. The adapter 30 with its primary stop 37 is braced on the housing 9 (optionally, via a spacer ring 50) via the second compression spring 31. The spring-supported adapter 30, in the position of repose, is spaced apart from the end stop 39 on the housing by a distance equivalent to the second axial stroke 47. In the position of repose of the control valve 4, the second compression spring 31 brings a greater force to bear than the first compression spring 10. In this state of repose, the adapter 30 rests on the housing 9 and keeps the second compression spring 31 prestressed. The first compression spring 10 is likewise prestressed, in the position of repose.

Thus two spring supports are provided, each for one spring 10 or 31 prestressed against the housing. The first spring support (flange 7) is rigidly joined to the valve tappet 5. The valve head 44 resting on the valve seat 11 limits the upward freedom of motion of the valve tappet 5 and thus assures the prestressing of the compression spring 10. The second spring support, on the adapter 30, is axially movable, beginning at the position of repose, in the direction of an increase in the spring force of the second compression spring 31; the housing stop 32 and the housing 9 (optionally in conjunction with the spacer ring 50) then assure the spring prestressing.

The prestressing of the first compression spring 10 can amount to from 10 to 20 N, for example, and that of the second compression spring 31 can amount to from 30 to 120 N, for example. In the range between 20 and 80 N, the primary stop 37 accordingly functions like a fixed stop. In this range, the first axial stroke 46 for the preinjection is still overcome. After the second axial stroke 47, which is now added to the first axial stroke, is overcome, the main injection is carried out.

Possibilities for Modification

Figure 2:
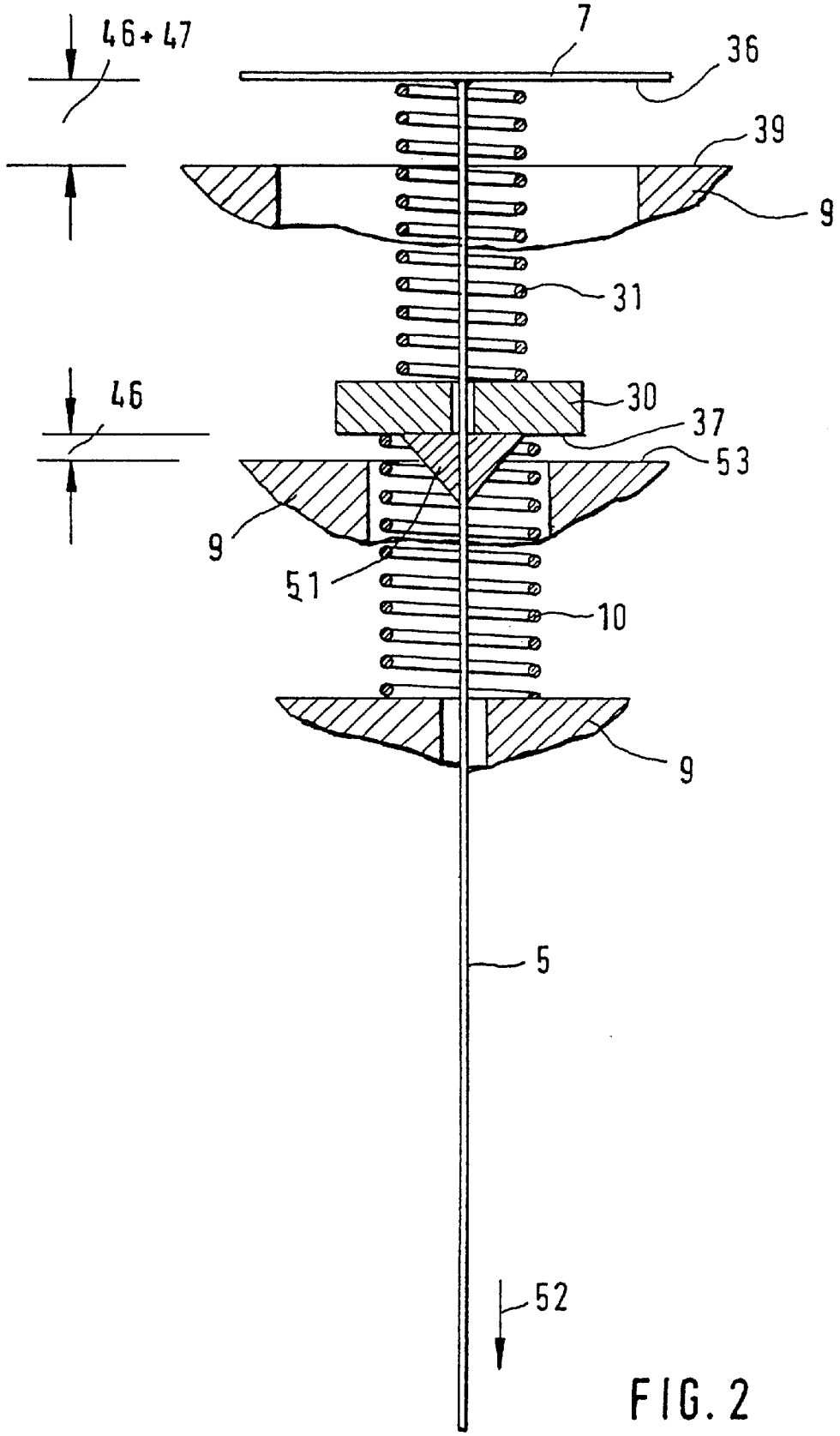
FIG. 2 shows a diagram of an alternative valve.

In the alternative shown in FIG. 2 in the state of repose, the second compression spring 31 again has a higher prestressing force than the first compression spring 10. A holder 51 rigidly joined to the valve tappet 5 limits the range of motion of the adapter 30 in the opening direction 52 of the control valve. In the opening process, the first compression spring 10 is first compressed, with the aid of the adapter 30, until the first axial stroke 46 has been overcome. If more force is exerted, the second compression spring 31 is compressed, until the total of the two axial strokes 46 and 47 has been overcome, when the driver stop 36 meets the end stop 39.

While in the exemplary embodiment of FIG. 1 the second compression spring 31 is connected parallel to the first compression spring 10 once the first axial stroke 46 is overcome, in FIG. 2 there is initially a series connection of the springs, but the first compression spring 10 becomes ineffective after the first axial stroke 46 is overcome. The relationships between the adapter, the housing, the stops and the springs are correspondingly different from those in FIG. 1. In FIG. 2, the second compression spring 31 is kept prestressed (with the interposition of the adapter 30) by the holder 51 and the flange 7. The first compression spring 10 is kept prestressed on the one hand by the housing 9 and on the other by the adapter 30; in the position of repose, the adapter is pressed by the second compression spring 31 against the holder 51. The first axial stroke 46 is limited by the primary stop 37 and a housing stop 53, while the total of the axial strokes, that is, 46+47, is equivalent to the spacing between the driver stop 36 and the end stop 39.

In other words, upon actuation of part 7 in the direction 52, because of the greater initial tension of the spring 31 compared with that of the spring 10, the adaptor 30 comes into contact with the holder 51, until the adapter cones into contact with the stop 53. If part 7 is moved onward, then the spring 31 must now be compressed, and the holder 51 thus lifts away from the adaptor 30. At the same time, the spring 31 is also compressed until such time as the part 7, with its underside 36, comes into contact with the stop 39. This ends the opening motion of the tappet 5. Upon closure, the process takes place in reverse order.

The foregoing relates to preferred exemplary embodiments of the invention, it being understood that other variants and embodiments thereof are possible within the spirit and scope of the invention, the latter being defined by the appended claims.

What is claimed is:

1. An injection valve for a fuel injection system for internal combustion engines, comprising means for multistage control of an effective cross section of at least one injection opening (42), these means having a spring/stop system, which when a control valve (4) opens allows a valve tappet (5) to move a first axial stroke (46), counter to a compressive force of a first compression spring (10) which movement is limited by a primary stop (37) that is located on an axially movable adapter (30), the axially movable adapter (30) is urged by a second compression spring (31) onto a stop (32) and an axial mobility of the adapter counter to the compressive force of the second compression spring (31) allows an additional second axial stroke (47) of the valve tappet (5), which is limited by a structural end stop

(39) of the housing, the control valve (4) controls a control chamber (12), a pressure of the control chamber determines a position of a valve shaft (2) of a metering valve (1); and the valve tappet (5) is urged in a closing direction of the control valve (4) by the first compression spring (10) braced against the housing (9) of the injection valve and movable in the axial direction directly or indirectly by a piezoelectric actuator (3), and in the closed state of the control valve (4) the spring force of the first compression spring (10) is less than that of the second compression spring (31), in which the first compression spring (10) and the second compression spring (31) are disposed, coaxially with the valve tappet (5), in the region between the piezoelectric actuator (3) and a valve head (44) of the control valve (4).

2. The injection valve in accordance with claim 1, in which the adapter (30) is guided axially movably on the valve tappet (5).

3. An injection valve for a fuel injection system for internal combustion engines, comprising means for multi-stage control of an effective cross section of at least one injection opening (42), these means having a spring/stop system, which when a control valve (4) opens allows a valve tappet (5) to move a first axial stroke (46), counter to a compressive force of a first compression spring (10) which movement is limited by a primary stop (37) that is located on an axially movable adapter (30), the axially movable adapter (30) is urged by a second compression spring (31) onto a holder (51) which is rigidly attached to valve tappet (5) and then onto a stop (53), and an axial mobility of the holder counter to the compressive force of the second compression spring (31) allows an additional second axial stroke (47) of the valve tappet (5), which is limited by a structural end stop (39) of the housing, the control valve (4) controls a control chamber (12), a pressure of the control chamber determines a position of a valve shaft (2) of a metering valve (1); and the valve tappet (5) is urged in a closing direction of the control valve (4) by the second compression spring (31) braced against the adaptor (30) and movable in the axial direction directly or indirectly by a piezoelectric actuator (3), and in the closed state of the control valve (4) the spring force of the first compression spring (10) is less than that of the second compression spring (31), and the adapter (30) is urged in the closing direction of the control valve (4) by said first compression spring (10) braced against the housing (9) of the injection valve, in which the first compression spring (10) and the second compression spring (31) are disposed, coaxially with the valve tappet (5), in the region between the piezoelectric actuator (3) and a valve head (44) of the control valve (4).

* * * * *